US005571342A

United States Patent [19]

Komatsubara et al.

[11] Patent Number: 5,571,342

[45] Date of Patent: Nov. 5, 1996

[54] DECARBURIZED STEEL SHEET FOR THIN ORIENTED SILICON STEEL SHEET HAVING IMPROVED COATING/MAGNETIC CHARACTERISTICS AND METHOD OF PRODUCING THE SAME

[75] Inventors: Michiro Komatsubara; Yasuyuki Hayakawa; Katsuo Iwamoto; Makoto Watanabe, all of Chiba, Japan

[73] Assignee: Kawasaki Steel Corporation, Japan

[21] Appl. No.: 166,736

[22] Filed: Dec. 14, 1993

Related U.S. Application Data

[60] Continuation of Ser. No. 36,029, Mar. 23, 1993, abandoned, which is a division of Ser. No. 797,438, Nov. 22, 1991, abandoned.

[30] Foreign Application Priority Data

Nov. 30, 1990 [JP] Japan ..... 2-336438

[51] Int. Cl.[6] ..... H01F 1/04

[52] U.S. Cl. ..... 148/308; 148/113; 427/127

[58] Field of Search ..... 148/111, 113, 148/306, 307, 308; 427/127

[56] References Cited

U.S. PATENT DOCUMENTS 5,203,928 4/1993 Inokuti et al. ..... 148/111

FOREIGN PATENT DOCUMENTS 02-8330 1/1990 Japan .

*Primary Examiner*—Sikyin Ip
*Attorney, Agent, or Firm*—Austin R. Miller

[57] ABSTRACT

A decarburized steel sheet for a thin oriented silicon steel sheet having improved magnetic and coating characteristics and a method of producing the same. Silicon steel strip is hot-rolled, cold-rolled to a final thickness of about 0.28 mm or less, subjected to decarburization/primary-recrystallization annealing, coated with an annealing separator, and thereafter subjected to finishing annealing. In the decarburization/primary-recrystallization annealing step, a novel subscale is formed at the steel sheet surface having a fayalite-silica composition ratio in accordance with an infrared reflection absorbance ratio of about 0.5 to 5.5, and a marked oxygen amount of about 0.4 to 1.6 g/m$^2$.

2 Claims, 8 Drawing Sheets

FAYALITE

SILICA

FAYALITE

SILICA

ABSORBANCE $$A_k = \ln \frac{I_{ok}}{I_k}$$

(CONDITION d)

(CONDITION e)

(CONDITION f)

DECARBURIZED STEEL SHEET FOR THIN ORIENTED SILICON STEEL SHEET HAVING IMPROVED COATING/MAGNETIC CHARACTERISTICS AND METHOD OF PRODUCING THE SAME

This application is a continuation of application Ser. No. 08/036,029 filed Mar. 23, 1993, abandoned, which is a divisional of U.S. application Ser. No. 07/797,438, filed Nov. 22, 1991, now abandoned.

BACKGROUND OF THE INVENTION, AND SHEET

This invention relates to a method of producing a thin oriented silicon steel sheet and to the decarburized steel sheet for a thin oriented silicon steel sheet product having a forsterite coat of reduced thickness which is uniform and improved in adhesion, and which has good magnetic characteristics.

As magnetic characteristics of an oriented silicon steel sheet, a high magnetic flux density and a small core loss are required.

After the recent energy crisis, trials have been made to reduce the energy loss of transformers, generators and the like. With this movement, needs for low-core-loss material for oriented silicon steel sheets have been increased. For reducing core loss, reducing the thickness of each steel sheet so that its electrical resistance is increased is most effective. Various studies have therefore been made to enable production of thinner steel sheets by gradually reducing the sheet thickness from about 0.30 mm to 0.28, 0.23, 0.20 and 0.18 mm.

With the reduction in thickness, oriented silicon steel sheets have actually been improved in core loss. However, a problem has then arisen in that when transformers are actually manufactured by using such silicon steel sheets, the energy loss reduction effect is not significantly large, contrary to expectation.

This is because as the thickness of steel sheets is reduced and the thinner sheets are used in a laminated arrangement when a transformer is assembled, the proportion of the volume occupied by the iron portions to the total volume of the core (hereinafter referred to as the "space factor") becomes smaller. The reduction of the space factor is mainly due to an increase in the proportion of the tensile coating layer and the forsterite coat formed under this layer.

Accordingly, if the thicknesses of these coating layers could be sufficiently reduced while the thickness of the steel sheet is also reduced, the space factor of the iron portions of the laminated structure might even be increased, in which case the problem would be solved. However, it is, in fact, difficult to reduce the coat thickness as well as the sheet thickness for the following reason. The thickness of the tensile coating can be reduced comparatively easily because the tensile force to be applied is reduced in proportion to the reduction of the steel sheet thickness. However, if the thickness of the forsterite coat is reduced, various surface coating characteristics, such as insulation performance, rust proofing performance, uniformity and adhesion, deteriorate simultaneously.

The forsterite coat is formed mainly by a solid phase reaction which takes place during finishing annealing. The reaction takes place between silica ($SiO_2$) in a subscale formed as an outer layer of the steel sheet during decarburization/primary-recrystallization annealing and magnesia (MgO) in an annealing separator applied to the steel sheet surface. This reaction is basically $$2MgO+SiO_2 \rightarrow Mg_2SiO_4.$$

Accordingly, to reduce the thickness of the forsterite coat it is necessary to reduce the amount of silica in the subscale formed by decarburization/primary-recrystallization annealing. However, it is known that if the amount of silica in the subscale is reduced the uniformity of forsterite coat formation is impaired and the adhesion and uniformity of the coat deteriorate. In conventional processes, therefore, the amount of oxides in the subscale formed during decarburization/primary-recrystallization annealing is controlled so as to be constant irrespective of the product sheet thickness. This is described in Japanese Laid-Open Patent Publication No.56-72178 or Japanese Patent Publication No.62-53577. For example, according to Japanese Patent Publication No.62-53577, the amount of oxygen per unit area (hereinafter referred to as the "marked oxygen" amount, which is generally proportional to the thickness of the forsterite coat) calculated is within the range of 0.7 to 1.4 g/m$^2$ irrespective of the sheet thickness, and is controlled to be generally constant. To form such a desirable coat, the marked oxygen amount in the step of decarburization/primary-recrystallization annealing is set to a constant value irrespective of the product sheet thickness, so that the thickness of the forsterite coat is constant. It is therefore difficult to form a forsterite coat on a thinner steel sheet while reducing the thickness of the forsterite coat as well as the overall thickness of the steel sheet. With a reduction in the steel sheet thickness, the problem of deterioration of magnetic characteristics also arises.

Generally, it is necessary to sufficiently grow secondary-recrystallized grains having an orientation called Goss orientation in the (110)[001] direction during finishing annealing in order to obtain an oriented silicon steel sheet having good magnetic characteristics.

Secondary-recrystallized grains having Goss orientation grow by nucleus generation in the vicinity of an outer layer of the steel sheet. For suitable secondary recrystallization it is necessary effectively to inhibit the normal growth of primary grains of other orientations by a precipitate called an inhibitor. However, the inhibitor in the outer layer of the steel sheet is easy to oxidize in a weakly oxidizing atmosphere during finishing annealing, so that the inhibition effect in the outer layer of the steel sheet is necessarily lost during finishing annealing. The nucleation frequency of secondary-recrystallized grains per unit surface area is reduced according to the reduction in the sheet thickness, and the nucleus generation positions become closer to the steel sheet surface with the reduction in the sheet thickness. Nucleation regions are therefore formed closer to the outer layer in which the inhibition effect of the inhibitor is lost, so that it is difficult to promote secondary recrystallization. There is therefore a critical sheet thickness.

The subscale formed at the steel sheet surface generally inhibits oxidation of the outer layer of the steel sheet, i.e., it protects against the weakly oxidizing atmosphere and therefore serves to prevent a reduction in the outer layer inhibition effect. However, if the coating thickness is reduced, the marked oxygen content of the subscale and hence the thickness of the subscale are reduced, which makes it further difficult to promote secondary recrystallization.

It is known that addition of Sb to the steel material is effective against such oxidation. This addition is intended to limit the oxidation effect of the atmosphere by utilizing segregation of Sb to the steel sheet surface, and has a significant oxidization limiting effect. However, addition of Sb simultaneously reduces the effect of the subscale in protecting the inhibitor against the atmosphere during finishing annealing, because Sb acts to deteriorate important properties of the subscale. This means is therefore commercially unsatisfactory.

Because decarburization/primary-recrystallization annealing has significant effects as described above, various atmosphere/temperature patterns for this annealing have been studied. However, they have been proposed to realize improvements in coating characteristics and magnetic characteristics and are necessarily intended to set a certain marked oxygen amount such that a thick coat is formed.

For example, Japanese Patent Publication No.57-1575 discloses a method of separating a decarburization/primary-recrystallization annealing step into first and second steps and reducing the oxygen potential $P(H_2O)/P(H_2)$ in the second step relative to that in the first step. Japanese Patent Publication no.54-24686 discloses a method of effecting decarburization/primary-recrystallization annealing at a temperature of 750° to 870° C. and thereafter effecting annealing in a non-oxidizing atmosphere at a high temperature of 890° to 1,050° C. before finishing annealing.

These methods, however, are intended to maintain a certain marked oxygen amount for sufficient decarburization, that is, to improve magnetic/coating characteristics by forming a thick subscale and do not enable formation of a thin coat.

Techniques intended to reduce the forsterite coat are disclosed in Japanese Patent Publication Nos. 58-55211 and 62-53577, but they are not based on studies of decarburization/primary-recrystallization annealing with respect to technical means for improving the coating characteristics while reducing the coat thickness, and are therefore unsatisfactory in terms of industrial production.

SUMMARY OF THE INVENTION

An object of the present invention is to provide an advantageous thin oriented silicon steel sheet having a forsterite coat of reduced thickness along with reduction in the sheet thickness, and having good magnetic and coating characteristics.

To solve the above-described problems, the inventors of the present invention have deeply studied properties of the subscale and conditions of decarburization/primary-recrystallization for forming a thinner uniform forsterite coat having improved adhesion, and have discovered that properties of the forsterite coat and magnetic characteristics of the sheet depend particularly greatly upon the compositions of oxides formed on the steel sheet surface during decarburization/primary-recrystallization annealing.

According to the present invention, there is provided a decarburized steel sheet for thin oriented silicon steel sheet having improved magnetic and coating characteristics and a method of producing the same, comprising the steps of hot-rolling a silicon steel strip containing silicon, cold-rolling the hot-rolled sheet one time or two times by interposing intermediate annealing until the sheet has a final thickness of about 0.28 mm or less, subjecting the sheet to decarburization/primary-recrystallization annealing, applying an annealing separator to the sheet, and thereafter subjecting the sheet to finishing annealing. This method is characterized in that in specially controlling the decarburization/primary-recrystallization annealing step a special subscale, containing a combination of silica and a combined oxide of silica and FeO called fayalite is formed at the steel sheet surface. The special subscale has a fayalite-silica composition ratio with an infrared reflection absorbance ratio of about 0.5 to 5.5, and a marked oxygen amount of about 0.4 to 1.6 $g/m^2$.

Other objects, arrangements and variations of the present invention will become apparent from the following detailed description of the invention and in the drawings. The drawings are intended to be directed to specific-forms of the invention selected for illustration and are not intended to limit the scope of the invention.

DESCRIPTION OF THE PREFERRED EMBODIMENT

Figure 1:
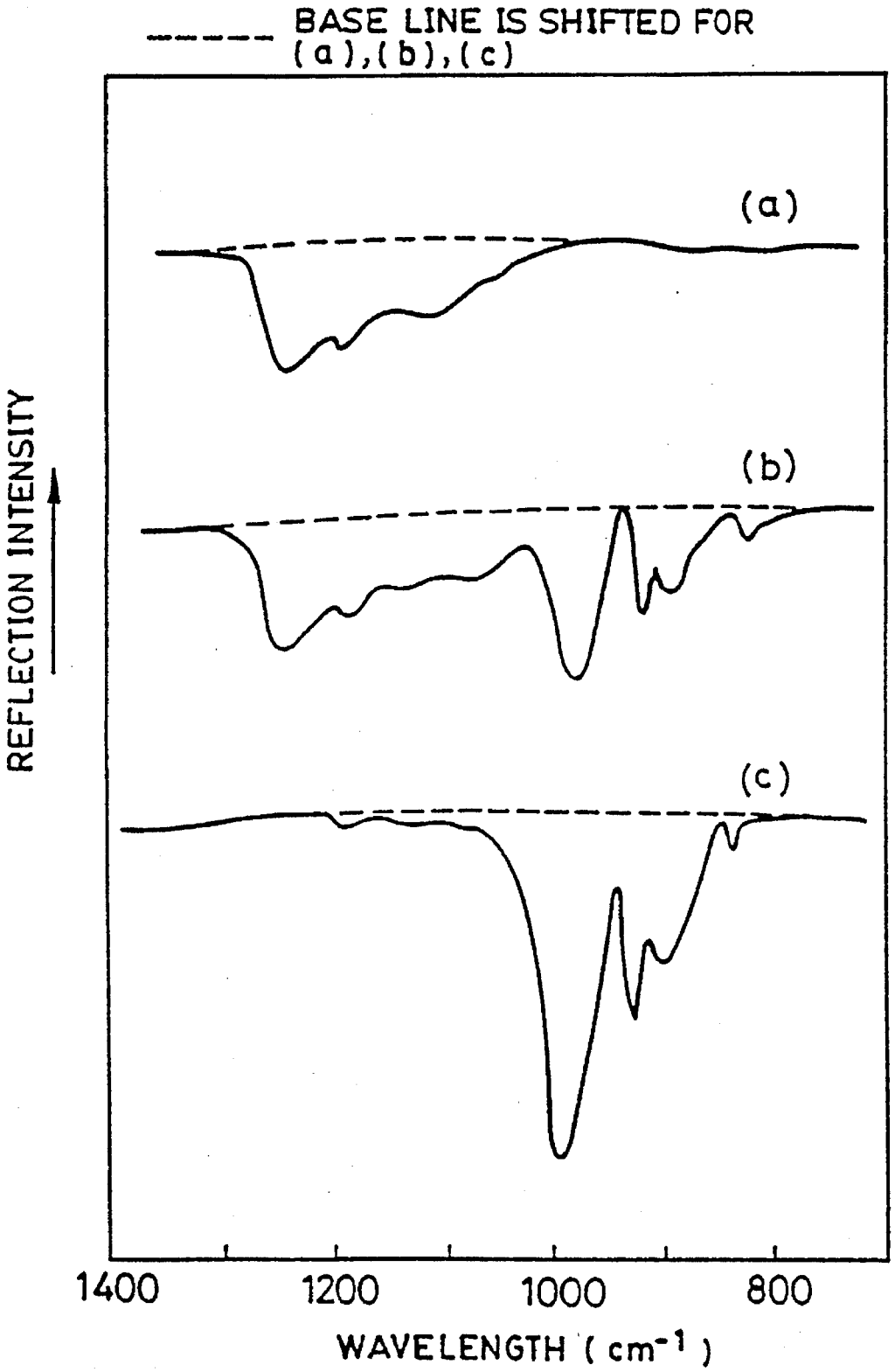
FIG. 1 is a diagram of changes of the infrared reflection spectrum of a steel sheet surface owing to differences of marked oxygen amount after it has been subjected to a surface oxide composition control process.

The description which follows is not intended to limit the scope of the invention and is directed to specific forms and examples of ways in which the invention may be carried out.

As a preliminary example, a steel strip for an oriented silicon steel containing 0.035% C, 3.2% Si, 0.075% Mn, and 0.020% Se was hot-rolled in a conventional manner and was thereafter subjected to normalizing annealing at 1,000° C., first cold rolling with a draft of 75%, intermediate annealing at 970° C., and second cold rolling with a draft of 63%, thereby being formed into the shape of a cold-rolled steel sheet having a final thickness of 0.225 mm. This steel sheet was cut into three pieces (a), (b), and (c), and each piece was subjected to decarburization/primary-recrystallization annealing at 840° C. for 2 minutes. During this annealing, the steel sheet (a) was treated at $P(H_2O)/P(H_2)=0.25$ for 120 seconds, the steel sheet (b) was treated at $P(H_2O)/P(H_2)=0.25$ for 100 seconds and then at 0.45 for 20 seconds, and the steel sheet (c) was treated at $P(H_2O)/P(H_2)=0.25$ for 100 seconds and then at 0.55 for 20 seconds. The marked oxygen amounts of these decarburized primary-recrystallized sheets (both surfaces were (a) 1.0 $g/m^2$, (b) 1.0 $g/m^2$, (c) 1.1 $g/m^2$, each lower than 1.5 to 2.0 $g/m^2$ conventionally considered suitable.

FIG. 1 shows results of infrared reflection spectrum analysis whereby surface oxides of these steel sheets after decarburization/primary-recrystallization annealing (hereinafter referred to as decarburized primary-recrystallized sheets) were measured.

It was found that, as oxides were produced on steel sheet surfaces, silica was formed under the condition (a), both silica and fayalite were formed under the condition (b), and only fayalite was formed under the condition (c), as shown in FIG. 1.

Figure 2A:
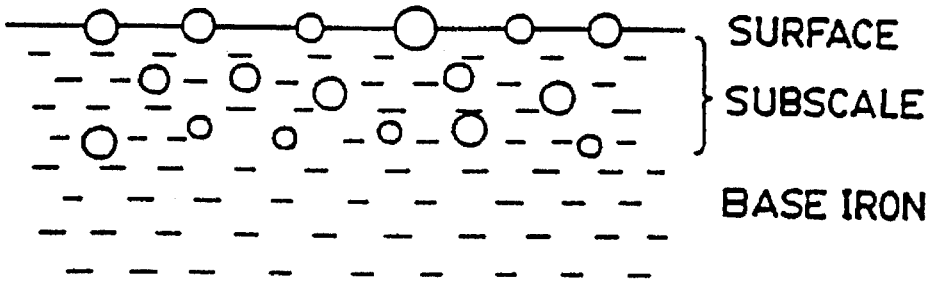
FIGS. 2(*a*) to 2(*c*) are schematic diagrams of oxide composition changes in the samples shown in FIG. 1 along cross sections thereof.
Figure 2B:
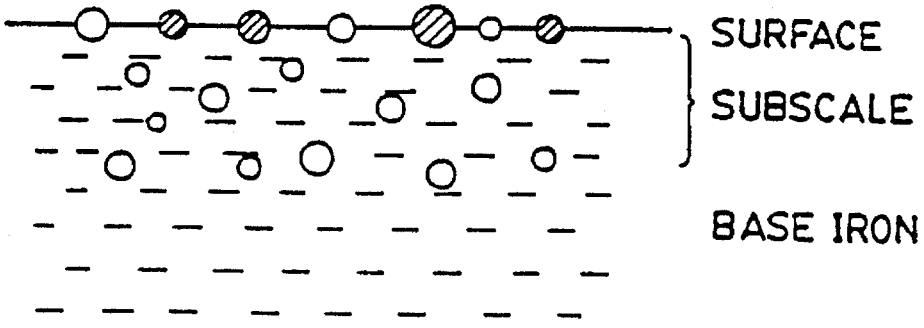
Figure 2C:
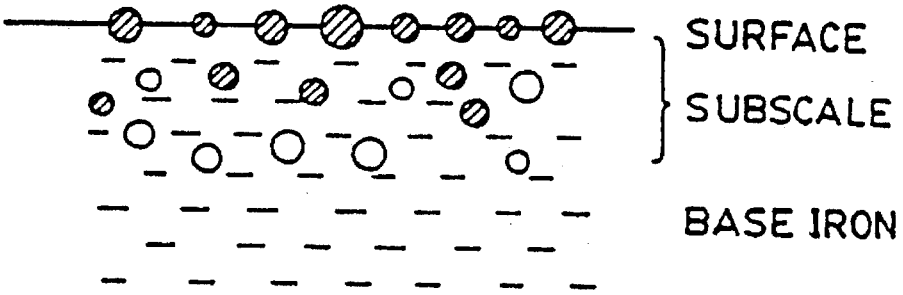

Cross sections of the steel sheets were examined with respect to subscales to find that in the sample (a) only silica existed as an oxide through the overall depth; in the sample (b) fayalite (a composite oxide of silica and FeO) and silica existed as oxides at the surface while only silica existed in the internal base iron portion; and in the sample (c) only fayalite existed as a surface oxide but the proportion of fayalite was reduced progressing in the direction into the base iron portion where only silica existed. FIG. 2 schematically shows these results, which correspond to those of the infrared reflection-spectrum measurement.

Next, an annealing separator having MgO as a main constituent was applied to the surfaces of these decarburized primary-recrystallized steel sheets, and the steel sheets were subjected to finishing annealing based on secondary-recrystallization annealing at 850° C. for 50 hours and purifying annealing at 1,200° C. for 10 hours.

In sample (a), a white forsterite coat was formed but it had poor adhesion and was exfoliated when unreacted MgO was removed. Moreover, the effect of secondary recrystallization was so poor that the crystal grains were very fine and equivalent to primary grains, and the magnetic flux was small, $B_8$=1.703 T.

In sample (b), a light gray uniform forsterite coat was formed, and had an improved degree of adhesion, i.e., it had a bending separation diameter of 30 mm. The forsterite coat formed on each side was an improved thin film having a thickness of 0.75 μm (2.4 g/m$^2$ in terms of marked oxygen amount on each side). Magnetic characteristics were also good; the magnetic flux density was Be=1,912 T, and the core loss was $W_{17/50}$=0.88.

In sample (c), a light gray forsterite coat was formed but local defects of the coat having a diameter of about 1 mm, called bare spots, were observed and the bending separation diameter was large, 50 mm. The magnetic characteristics were poorer than those of ordinary conventional products; the magnetic flux density was $B_8$=1.878 T, and the core loss was $W_{17/50}$=0.98. Further, some portions of the steel sheet were not sufficiently secondary-recrystallized.

As is apparent from these results, the nature of the oxide composition at the steel sheet surface is important for obtaining good coating and magnetic characteristics of a thin coat.

These discoveries have led us to discover that control of the oxides in the subscale, specifically control of the composition of fayalite and silica, is important. For example, according to a conventional method, the composition is controlled so that the composition ratio of fayalite and silica is 0.1 to 0.3. However, this control is effected with respect to the entire composition of the subscale, and it has been difficult to control the composition independently of the marked oxygen amount. That is, if the oxygen potential of the atmosphere is increased to the high-oxidation side in order to increase the proportion of fayalite generated on the high-oxidization side, the silica generation reaction is necessarily promoted, so that the marked oxygen amount is also increased under the condition for setting the desired content of fayalite.

In contrast, according to the present invention, it has been discovered to be important to control the oxide composition at the steel sheet surface, and this control can be achieved by atmosphere annealing within a short period of time such that the marked oxygen amount is not influenced as in the case of the above-described experiment.

A fayalite-silica ratio according to this invention and quantitative evaluation of the same will be described below.

Generally, Si has a stronger affinity for oxygen than Fe has in silicon steel sheets, and a silica oxide is therefore formed in an outer layer of the steel sheet by the reaction:

$$Si+2O \rightarrow SiO_2.$$

If the oxygen potential for this reaction is increased, the generated silica is converted into fayalite by the reaction:

$$2Fe+SiO_2+2O \rightarrow Fe_2SiO_4.$$

If the oxygen potential is further increased, Fe itself is oxidized to form FeO by the reaction:

$$Fe+O \rightarrow FeO.$$

It is seldom that decarburization/primary-recrystallization annealing is effected in such a high-oxidation atmosphere, because FeO is detrimental to the forsterite coat formation reaction.

Silica formed in this process is amorphous while fayalite is crystalline. It is therefore difficult to determine their contents by X-ray. Furthermore, since silica and fayalite coexist at the steel surface, the individual contents of each cannot be ascertained by quantitative analysis based on ordinary chemical analysis or elementary analysis. We have accordingly created a special analytical method using an infrared reflection spectrum.

Figure 3:
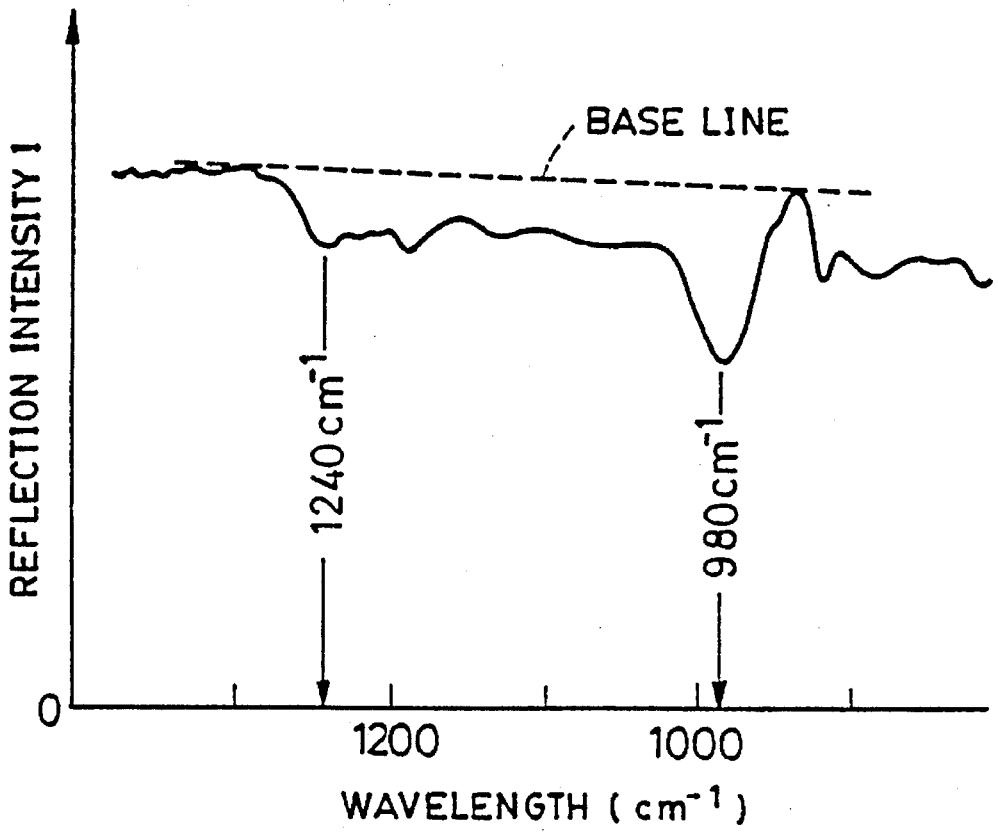
FIG. 3 is a diagram relating to a procedure for deriving a surface oxide composition ratio from an infrared reflection spectrum.

FIG. 3 shows an infrared reflection spectrum in a case where silica and fayalite coexist at the steel sheet surface. Absorbances $A_s$ and $A_f$ of silica and fayalite were measured by using an absorption peak of silica at 1,240 cm$^{-1}$ and an absorption peak of fayalite at 980 cm$^{-1}$.

Figure 4:
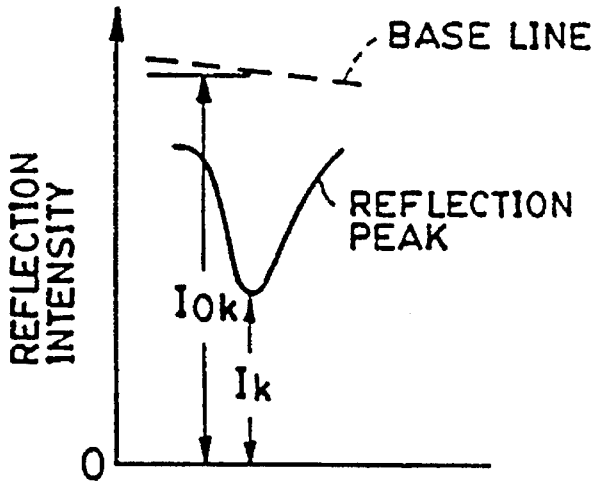
FIG. 4 is another reflection intensity diagram.

FIG. 4 is a diagram of absorbance $A_k$ and a definition formula: $A_k=\ln(I_{0k}/I_k)$. The reflection light intensity $I_k$ at the peak position with respect to $I_{0k}$ set as the base line intensity was measured and $\ln(I_{0k}/I_k)$ was calculated. $A_k$ is proportional to the amount of material which absorbs light at the peak position.

Therefore the ratio $A_f/A_s$ of the absorbance $A_f$ of fayalite and the absorbance $A_s$ of silica represents the quantitative ratio of fayalite and silica at the steel sheet surface.

To ascertain a suitable ratio of fayalite and silica at the steel sheet surface, the same experiment as that described above was repeated with respect to a steel sheet having a thickness of 0.195 mm, and magnetic characteristics and coating characteristics thereof were examined. A steel sheet obtained by adding 0.020% by weight of Sb to the above-mentioned steel sheet containing 0.035% C, 3.2% Si, 0.075% Mn, and 0.020% Se was formed as a hot-rolled plate by an ordinary method, and was thereafter subjected to normalizing annealing at 1,000° C. for 1 minute, first cold rolling with a draft of 75%, intermediate annealing at 970° C., and second cold rolling with a draft of 63%, so that the thickness was reduced to a final thickness of 0.195 mm. The cold-rolled steel sheet was then processed by decarburization annealing while variously changing the temperature and the atmosphere, thereby producing a plurality of decarburized annealed coils. An annealing separator containing MgO as a main constituent was applied to each of the coils, and each coil was subjected to finishing annealing at 1,200° C. Oriented silicon steel sheets were thus produced.

Figure 5:
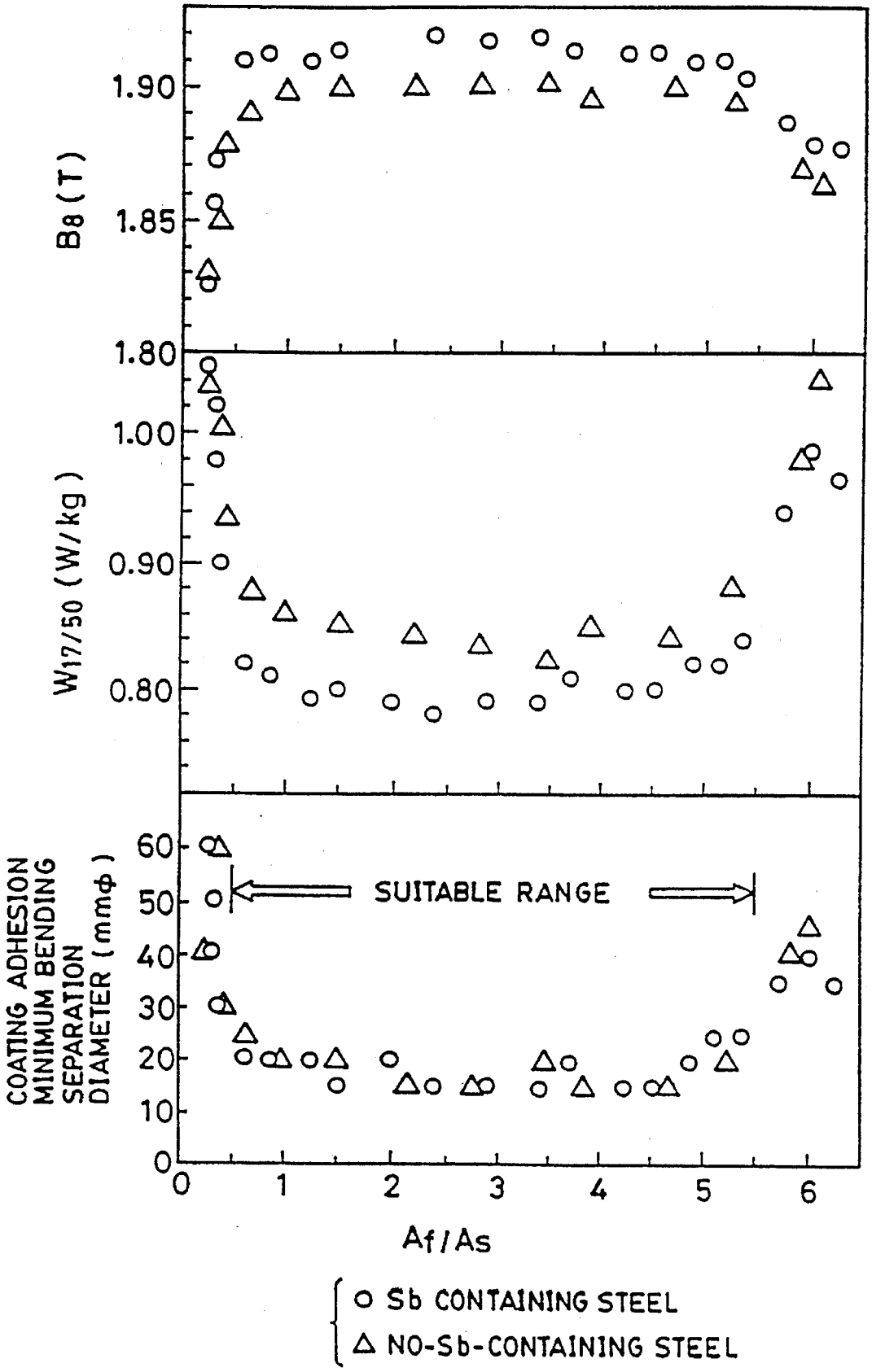
FIG. 5 is a graph of relationships among the surface oxide composition ratio $A_f/A_s$, the magnetic characteristics and the coating characteristics of a sheet.

Among the steel sheets thereby produced, those having $A_f/A_s$ in the range of 0.5 to 5.5 were good in both magnetic and coating characteristics. Specifically, as can be understood from FIG. 5, the steel sheets containing Sb were excellent in both magnetic and coating characteristics.

The formation of a thin coat based on application of decarburization/primary-recrystallization annealing in accordance with the present invention was then examined with respect to suitable ranges of marked oxygen amounts.

The above-mentioned steel sheet containing 0.035% C, 3.2% Si, 0.075% Mn, and 0.020% Se was rolled into a steel sheet having a thickness of 0.195 mm by an ordinary method using two-time cold rolling. At the time of soaking for decarburization/primary-recrystallization annealing, the atmosphere and the time for the treatment were changed to set various marked oxygen amounts (conventional method). Some of the steel sheets thereby obtained underwent a surface oxide composition control treatment for 25 seconds in an atmosphere in which $P(H_2O)/P(H_2)$ was 0.44 after the soaking annealing (surface oxide composition control method).

In the case where the marked oxygen amount was changed in accordance with the conventional method, the $A_f/A_s$ value ranged from 0.0 to 0.4. In the case of the steel sheets which underwent the surface oxide composition control treatment, variations in $A_f/A_s$ fell into the range of 0.8 to 3.5 no matter what the marked oxygen amount.

An annealing separator containing MgO as a main constituent was,applied to surfaces of each of the decarburized primary-recrystallization-annealed plates then obtained, and each steel sheet was subjected to finishing annealing consisting of secondary recrystallization annealing at 850° C. for 50 hours and purifying annealing at 1,200° C. for 10 hours.

Figure 6:
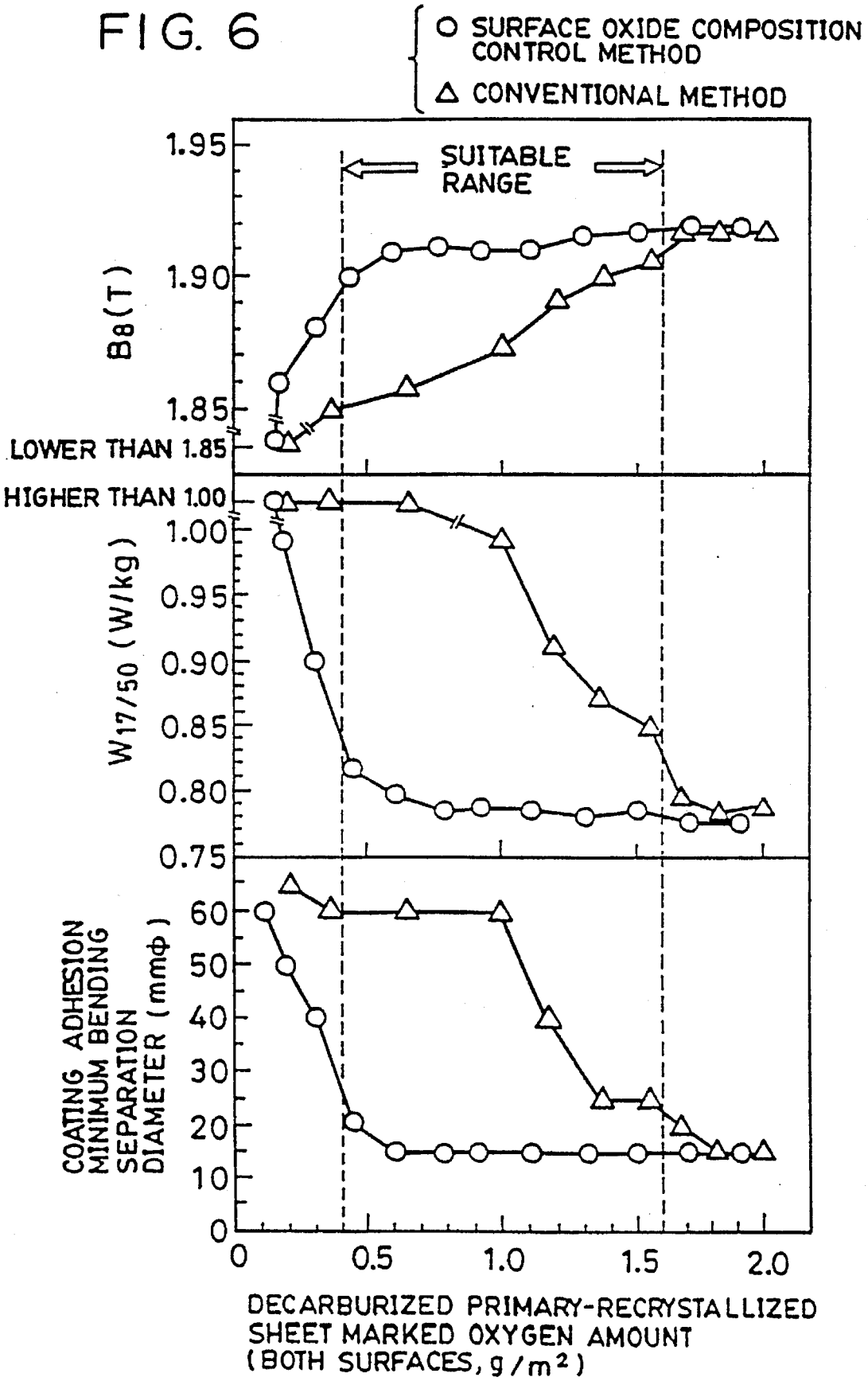
FIG. 6 is a graph of relationships among the marked oxygen amount, the magnetic characteristics and the coating characteristics of a decarburized primary-recrystallized sheet.

FIG. 6 shows the relationship between the marked oxygen amount, magnetic characteristics and coating adhesion of the decarburized primary-recrystallized sheets. As can be seen from FIG. 6, the effect was unsatisfactory when the marked oxygen amount was smaller than about 0.4 g/m$^2$, but the treatment enabled remarkable improvement effects in comparison with the conventional method with respect to both the magnetic characteristics and the coating adhesion when the marked oxygen amount was smaller in the range of about 0.4 to 1.6 g/m$^2$.

As described above, a suitable value of $A_f/A_s$ in decarburization/primary-recrystallization annealing can be achieved by the surface oxide composition control treatment in which the annealing atmosphere is controlled for about 20 to 30 seconds at a final stage of decarburization/primary-recrystallization annealing. The results show that the time through which the surface oxide,composition control treatment was in effect during the annealing is, preferably, a time at the final stage at which the decarburization reaction and the oxidation reaction are completed. To avoid serious negative influence upon the marked oxygen amount, a short treatment time, e.g., about 20 to 30 seconds, is preferred. Such a short length of time may suffice to change the oxide composition at the steel sheet surface. The reactions of the oxides at the steel sheet surface may effectively be promoted by changing the treatment temperature.

A description will now be given of an examination made by the inventors of the present invention with respect to the mechanism of such a steel sheet surface oxide composition control producing highly useful effects in improving the coating and magnetic characteristics of the sheet.

Where only silica exists at the steel sheet surface, forsterite is formed by the reaction:

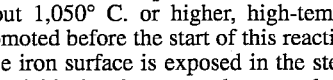

$$2MgO+SiO_2 \rightarrow Mg_2SiO_4.$$

According to studies made by the inventors, since this reaction is a solid phase reaction at a high temperature of about 1,050° C. or higher, high-temperature oxidation is promoted before the start of this reaction in a place where a base iron surface is exposed in the steel sheet surface. The material is thereby exposed to a weak-oxidizing atmosphere at a higher temperature for a longer time in comparison with decarburization/primary-recrystallization annealing. Inhibitors such as MnSe, MnS, and AlN are therefore decomposed and oxidized in the outer layer of the steel sheet, so that the outer layer inhibition effect is lost, resulting in a secondary recrystallization failure and, hence, a deterioration in magnetic characteristics. Moreover, since high-temperature oxidation is promoted, the coating characteristics are also deteriorated.

In contrast, if silica and fayalite exist at a controlled ratio at the steel sheet surface, a forsterite coat is partially formed in a low-temperature range of 850° to 950° C. by a substitution reaction of iron and Mg during finishing annealing, by the following reaction formula:

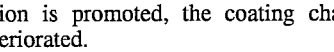

$$Fe_2SiO_4+2MgO \rightarrow Mg_2SiO_4+2FeO.$$

Protection against high-temperature oxidation is thereby provided, so that the inhibition effect of the surface inhibitors can be maintained. Also, a small amount of fayalite acts as a catalyst to reduce the temperature at which the forsterite coat forming reaction based on a solid phase reaction:

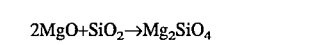

$$2MgO+SiO_2 \rightarrow Mg_2SiO_4$$

is started.

Thus, both the coating and magnetic characteristics can remarkably be improved.

However, when an excessive amount of fayalite is formed at the surface of the sheet, inhibitors such as MnS, MuSe and AlN existing in the outer layer are decomposed by, for example, the reaction:

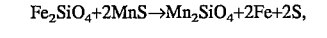

$$Fe_2SiO_4+2MnS \rightarrow Mn_2SiO_4+2Fe+2S,$$

so that the outer layer inhibition effect is also lost, resulting in a deterioration in magnetic characteristics. Moreover, as fayalite aggregates, the forsterite coat locally thickens excessively and is separated at the thickened position, resulting in occurrence of a coating defect called a bare spot.

A method of reducing the marked oxygen amount will be described below. A reduction in the marked oxygen amount can be achieved by reducing the oxygen potential in the atmosphere for a first soaking step.

That is, the oxygen potential $P(H_2O)/P(H_2)$ is selected according to a target marked oxygen amount. A value of $P(H_2O)/P(H_2)$ of about 0.15 to 0.35 is suitable for setting a low marked oxygen amount for forming a thin coat, e.g., about 0.4 to 1.6 g/m$^2$. A steel sheet annealed for decarburization/primary-recrystallization in such a low-oxidization atmosphere is always deteriorated in both magnetic and coating characteristics in the case of the conventional methods. According to the present invention, it is possible to realize remarkably improved magnetic and coating characteristics by controlling the surface oxide composition in a second step of decarburization/primary-recrystallization annealing.

In a case where the oxygen potential of the atmosphere in the first step before decarburization/primary-recrystallization annealing is reduced, decarburization failure is most strongly apprehended. In this respect, according to the experiments and studies made by the inventors, it is possible to remove a greater part of carbon in the steel during a temperature rising process by maintaining high atmosphere oxygen potential or increasing the temperature rising rate.

Figure 7:
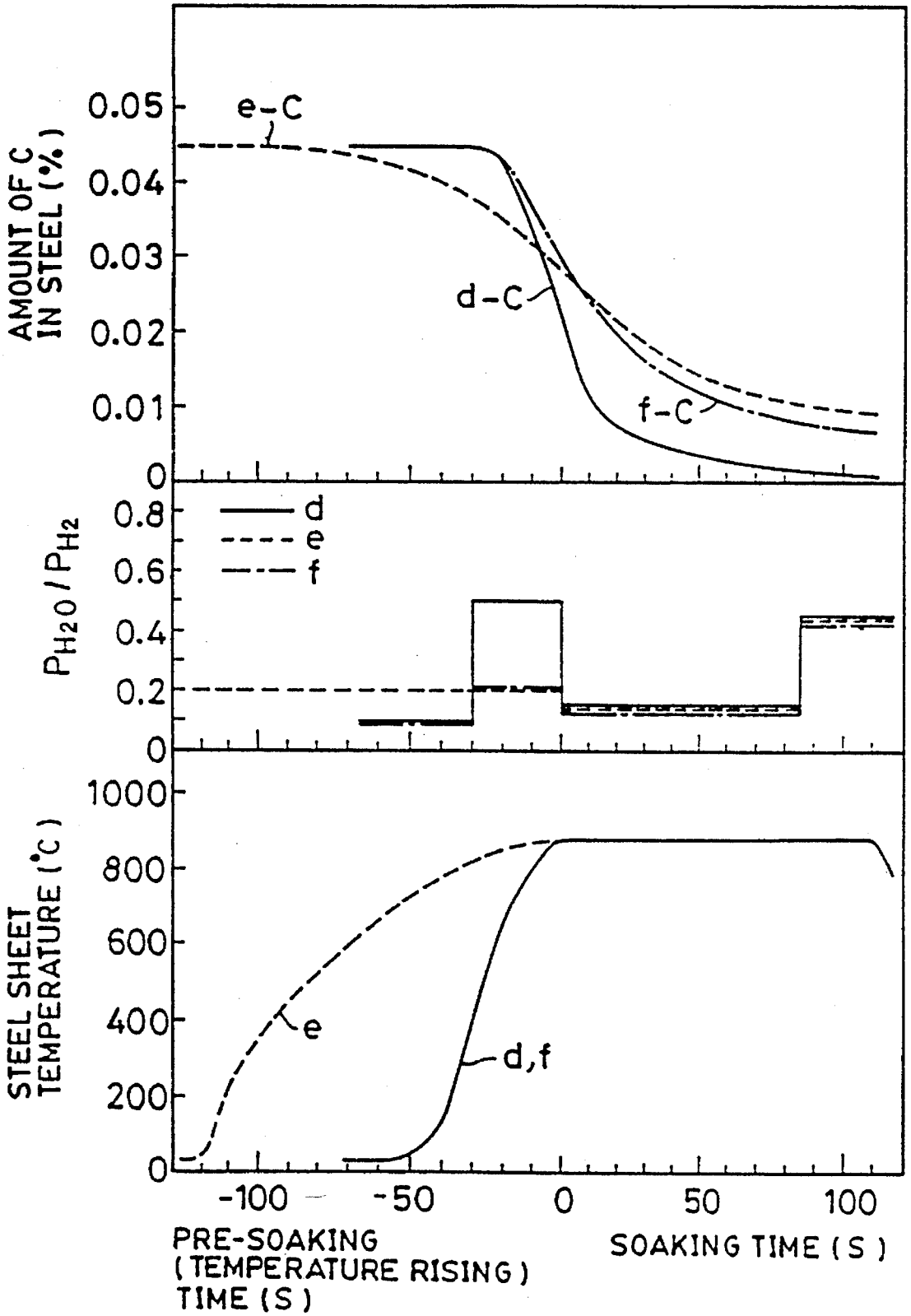
FIG. 7 is a graph showing the change in the amount of C in steel sheets with changes in atmosphere pattern and heat pattern.

FIG. 7 shows the results of an experiment made to examine decarburization behavior by using a finishing-cold-rolled steel sheet containing 0.045% of C and 3.25% of Si (thickness: 0.23 mm) and by changing the temperature rising rate (20° C./s for conditions d and f and 6.7° C./s for condition e in the range of 400° to 800° C.) and the oxygen potential in the atmosphere $P(H_2O)/P(H_2)$: 0.50 for condition d and 0.20 for conditions e and f) during temperature rising. The extent of decarburization is insufficient in a case where the oxygen potential during temperature rising is low (condition f) or in a case where the temperature rising rate is low (condition e).

Figure 8A:
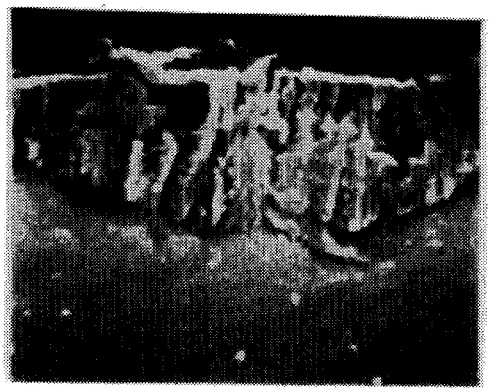
FIGS. 8(*a*) to 8(*c*) are photographs of metallic structures seen in cross-section of steel sheets showing the conditions of the subscales immediately after temperature rise.
Figure 8B:
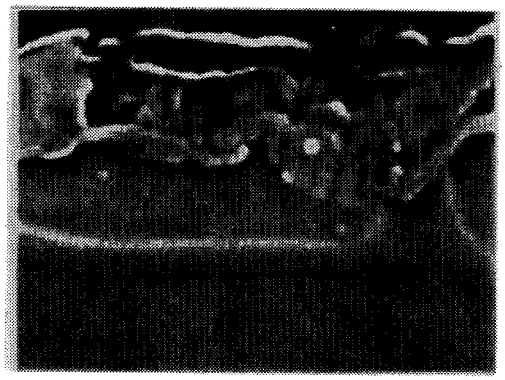
Figure 8C:
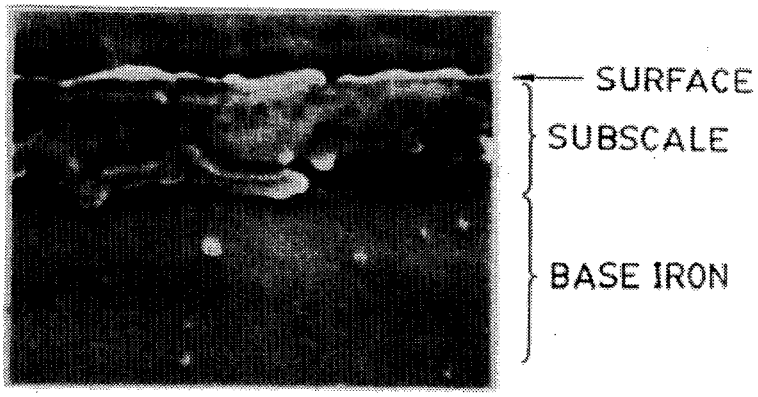
Figure 9A:
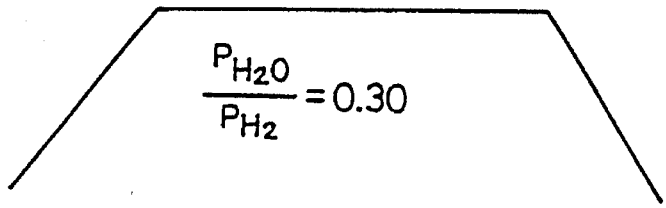
FIGS. 9(*a*) to 9(*f*) are schematic diagrams of heat patterns and atmosphere patterns used in the Examples.
Figure 9B:
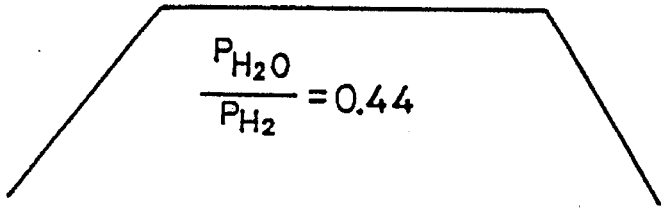
Figure 9C:
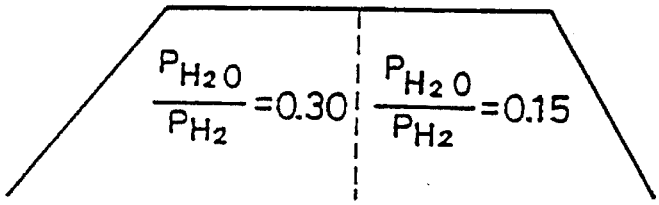
Figure 9D:
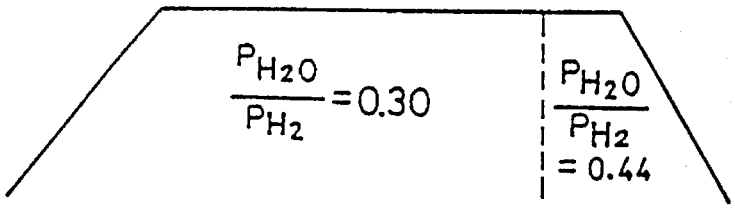
Figure 9E:
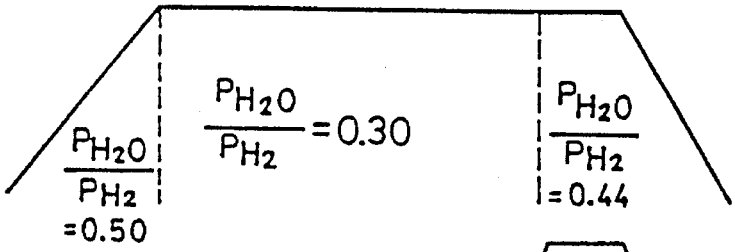
Figure 9F:
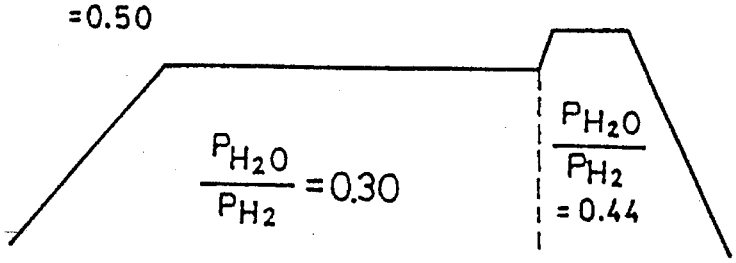

This is because the structure of the subscale formed during the temperature rising process is changed according to the conditions, as shown in SEM photographs of FIG. 8 in cross section with respect to a state immediately after the temperature rising. Under condition f, an oxide (identified as silica by analysis) is finely formed at the surface. In contrast, under condition d, an oxide (also identified as silica by analysis) is formed into a comb-like shape along a slip caused by cold rolling. It is considered that such a difference between the forms of initial oxidization products influences the diffusion behavior of C during temperature rising or the subsequent soaking step and appears as a change in decarburization behavior as shown in FIG. 7. This phenomenon easily occurs particularly when the annealing atmosphere for the first half soaking is selected for low-oxidation effect as shown in FIG. 7.

Studies made by the inventors have revealed that an oxygen potential range suitable for the atmosphere for the temperature rising process for promoting decarburization is about 0.35 to 0.60 in terms of $P(H_2O)/P(H_2)$. The temperature range for this process is not especially critical here; however, there is no need to limit the temperature to the range not higher than 400° C. since decarburization and oxidation do not proceed. Preferably, the rate of temperature rise for promoting decarburization is high. The range of about 10° to 25° C./s is particularly preferred as an average temperature rising rate from about 400° to 800° C. This is because if the rate is lower than about 10° C./s, fine silica oxide film is formed on the steel sheet surface to hinder decarburization, while, if the rate exceeds about 25° C./s, it is strongly possible that the time for decarburization during the temperature rising period is insufficient.

A description will be given below of a suitable composition of constituents of the steel strip for the oriented silicon steel sheet in accordance with the present invention.

The presence of C is necessary for improving the hot-rolled structure. However, if the content of C is excessively large, it is difficult to decarburize the steel. It is therefore preferable to set the content of C to about 0.035 to 0.090%.

If the content of Si is too small, the electrical resistance is so reduced that good core loss characteristics cannot be obtained. If it is excessively large, it is difficult to cold-roll the steel sheet. It is therefore preferable to set the Si content within the range of about 2.5 to 4.5%.

Mn is required as an inhibitor component. However, if the Mn content is excessively large, the inhibitor becomes coarse. It is therefore preferable to set the Mn content within the range of about 0.040 to 0.10.

Desired contents of inhibitor strengthening elements, such as Cu, Cr, Bi, Sn, B, and Ge, may be added as well as those for MnS, MnSe and AlN precipitates. The contents of such elements may be set to established ranges. Also, Mo can be added for the purpose of preventing occurrence of a surface defect due to thermal embrittlement.

Conventional production methods may be applied to the process of producing the steel material itself. The ingot or slab thereby produced may be produced and formed to the desired size and thereafter heated and hot rolled. After hot rolling the steel band may be heat-treated and cold-rolled one time or cold-rolled two times and annealed between the two cold rolling steps to achieve the desired final thickness.

The surfaces of the finishing-cold-rolled steel sheet are cleaned by degreasing such as electrolytic degreasing. The steel sheet is thereafter subjected to decarburization/primary-recrystallization annealing which relates to the essentials of the present invention. It is important to control the process of this annealing so that the subscale of the decarburized primary-recrystallized sheet has a marked oxygen amount of about 0.4 to 1.6 g/m$^2$ (two-surface total), and so that the fayalite-silica composition ratio of the oxide composition at the steel sheet surface is defined by an infrared reflection absorbance $A_f/A_s$ of about 0.5 to 5.5.

Sufficient protection against high-temperature oxidation cannot be obtained if the marked oxygen amount is not greater than about 0.4 g/m$^2$ and under this condition the coating and magnetic characteristics deteriorate considerably. In the case of a marked oxygen amount exceeding about 1.6 g/m$^2$ the thickness of the forsterite coat is increased so that the aforementioned space factor is considerably reduced when the steel sheet is formed.

The value of the marked oxygen amount of a steel sheet is calculated by the following equation:

$$\text{Marked oxygen amount: } Dt(O_f-Os)\times10^{-3}(g/m^2)$$

D: Density of steel sheet (g/cm$^3$)

t: Thickness of steel sheet (mm)

$O_f$: Oxygen content in steel sheet after decarburization/primary-recrystallization annealing (PPM)

Os: Oxygen content in steel sheet before decarburization/primary-recrystallization annealing (PPM)

If $A_f/A_s$ at the steel sheet surface is not greater than about 0.5, the high-temperature oxidation and the decomposition reaction of inhibitors proceed by the weak-oxidizing atmosphere during finishing annealing, so that the magnetic characteristics deteriorate in the case of a thin steel sheet. If $A_f/A_s$ exceeds about 5.5, both the magnetic and coating characteristics deteriorate. The coating characteristics, more particularly including the degree of adhesion, are considerably reduced when the marked oxygen amount is reduced only for the purpose of reducing the coat thickness. According to the present invention, therefore, it is most important to control the composition ratio of fayalite and silica within the $A_f/A_s$ range of about 0.5 to 5.5.

To inhibit high-temperature oxidation of inhibitors during finishing annealing of the steel sheet, the steel sheet surface segregation effect of Sb may be utilized as well as the above-described improvement in the qualities of the subscale to achieve a further advantageous effect. In this case, for a substantially large increase in the effect of Sb, addition of at least about 0.005% Sb is required. If the Sb content exceeds about 0.050%, the properties suitable for being rolled are impaired. It is therefore preferable to add about 0.005 to about 0.050% Sb.

According to a simplest and most convenient method for realizing this composition of surface oxides in the subscale, it is suitable to treat the steel sheet in an atmosphere having a $P(H_2O)/P(H_2)$ value of about 0.40 to 0.50 for about 20 to 30 seconds in a surface oxide composition control step after soaking for decarburization/primary-recrystallization annealing. If the oxygen potential $P(H_2O)/P(H_2)$ is out of the above-mentioned range, the majority of surface oxides may be silica or fayalite, or the amounts of silica and fayalite may be unbalanced, so that both the coating and magnetic characteristics deteriorate. If the treatment time is shorter than about 20 seconds, the desired effect cannot be obtained. If the treatment time is longer than about 30 seconds, the fayalite composition is so large that a suitable $A_f/A_s$ value cannot be obtained. To promote the reaction, it is possible to treat the steel sheet at a temperature slightly higher than the soaking temperature.

As the thickness of the steel sheet is reduced, the importance of reducing the marked oxygen amount of the subscale determined by decarburization/primary-recrystallization annealing. It is possible to adjust the marked oxygen amount to about 0.4 to 1.6 g/m$^2$ by adjusting the oxygen potential $P(H_2O)/P(H_2)$ of the atmosphere in the soaking range to about 0.15 to 0.35 or by reducing the annealing temperature or the annealing time even when the oxygen potential is high.

A possibility of decarburization failure is apprehended when a steel sheet having a large C content is processed by this treatment. However, this can suitably be achieved by increasing the oxygen potential during the temperature rising period to about 0.35 to 0.60.

The oxygen potential is defined by the partial pressures of water vapor and hydrogen and is ordinarily controlled by using the dew point and the hydrogen partial pressure in a moist hydrogen atmosphere containing nitrogen gas.

With respect to decarburization, it is very advantageous to effect quenching by setting the temperature rising rate in the range of about 10° to 25° C./s. If the temperature rising rate is lower than about 10° C./s, fine silica oxide layer undesirable for decarburization is formed at the steel sheet surface. If the temperature rising rate exceeds about 25° C./s, a time long enough for decarburization cannot be obtained at the time of temperature rising.

An annealing separator containing MgO as a main constituent may be applied to the steel sheet, and the steel sheet may be wound into a coil and subjected to finishing annealing. An insulating coating is thereafter formed if necessary to finish the product.

The following examples are further illustrative of the invention:

EXAMPLE 1

A hot-rolled sheet containing 0.038% C, 3.25% Si, 0.067% Mn and 0.016% S and having a thickness of 2.2 mm was acid-cleaned and was cold-rolled until its thickness was reduced to 0.58 mm. The rolled sheet was then subjected to intermediate annealing at 950° C. for 2 minutes and was cold-rolled to a final thickness of 0.22 mm.

Cold-rolled sheets thus obtained were annealed in accordance with the atmosphere patterns shown in view (a), (b), (c), (d), (e), and (f) of FIG. 9 to be decarburized and primary-recrystallized. The patterns (a), (b), and (c) were selected in accordance with a conventional method and the patterns (d), (e), and (f) were selected in accordance with the present invention. For annealing in accordance with each pattern, the temperature rising rate was set to 15° C./s (in the range of 400° to 800° C.), the soaking temperature was set to 840° C. and the soaking time was set to 100 seconds. The time for a treatment in the surface oxide composition control step additionally effected after soaking of each of the patterns (d), (e), and (f) was set to 25 seconds. In the case of the pattern (f), the temperature of this treatment was 880° C. In the case of the pattern (e), the oxidizing potential was increased to $P(H_2O)/P(H_2)=0.50$. For annealing in accordance with each of the patterns (a) to (f), $N_2$ gas was used as a cooling atmosphere.

The marked oxygen amount and the composition ratio $A_f/A_s$ of each steel sheet thus treated were as shown in Table 1.

An annealing separator containing MgO as a main constituent was applied to each steel sheet, and the steel sheet was finishing-cold-rolled in a dry $H_2$ flow at 1,200° C. for 10 hours.

The thickness of the forsterite coat and coating and magnetic characteristics of each product sheet thus obtained were examined. The results of this examination are also shown in Table 1. It is thereby understood that the steel sheets formed in accordance with the present invention are superior in both the coating and magnetic characteristics.

TABLE 1

| Decarburization Primary-recrystallization Annealing Method | Marked Oxygen Amount (g/m$^2$) | Surface Oxide Composition Ratio $A_f/A_s$ | Amount of Residual C (%) | Magnetic Flux Density $B_8$(T) | Core Loss $W_{17/50}$ (W/kg) | Coat Bending Adhesion (mmϕ) | Coat Thickness (μm) |
|---|---|---|---|---|---|---|---|
| 9(a) (Conventional Method) | 1.43 | 0.02 | 0.0015 | 1.683 | 1.31 | 70 | 1.30 |
| 9(b) (Conventional Method) | 1.85 | 17.3 | 0.0008 | 1.875 | 0.97 | 40 | 1.42 |
| 9(c) (Conventional Method) | 1.40 | 0.01 | 0.0015 | 1.715 | 1.34 | 80 | 1.25 |
| 9(d) (Method of the Invention) | 1.45 | 1.73 | 0.0014 | 1.905 | 0.85 | 20 | 1.02 |
| 9(e) (Method of the Invention) | 1.47 | 1.85 | 0.0009 | 1.909 | 0.83 | 20 | 1.05 |
| 9(f) (Method of the Invention) | 1.49 | 2.37 | 0.0012 | 1.908 | 0.83 | 20 | 1.03 |

EXAMPLE 2

Each of steel ingots having various compositions shown in Table 2 was formed into a hot-rolled sheet having a thickness of 2.0 mm by an ordinary method. This hot-rolled sheet was annealed at 1,000° C. to be made uniform, was acid-cleaned and was thereafter cold-rolled until its thickness was reduced to 0.44 mm. The steel sheet was thereafter subjected to intermediate annealing at 950° C. cold-rolled until the thickness was reduced to 0.17 mm, and cut into two pieces. These sheets were annealed in accordance with atmosphere pattern (a) (comparative example), and pattern (f) (Example of the present invention) of FIG. 9 to be decarburized and primary-recrystallized. For this annealing, the temperature rising rate was set to 13° C./s (in the range of 400° to 800° C.), the soaking temperature was set to 820° C. and the soaking time was set to 120 seconds. The surface oxide composition control treatment in the case of the pattern (f) was effected at 850° C. for 30 seconds. Table 3 shows values of the marked oxygen amount, the composition ratio $A_f/A_s$ of surface oxides and the amount of residual C of each steel sheet.

An annealing separator containing MgO as a main constituent was applied to each steel sheet, and the steel sheet was treated by finishing cold rolling in $H_2$ at 1,200° C. for 5 hours including secondary recrystallization annealing in $N_2$ at 850° C. for 50 hours.

Table 3 also shows the results of examination of the thickness of the forsterite coat and coating and magnetic characteristics of each product sheet thus obtained.

TABLE 2

| | Composition (%) | | | | | | | | | |
|---|---|---|---|---|---|---|---|---|---|---|
| Sample | C | Si | Mn | P | S | Se | Cu | Mo | Sb | Sn |
| A | 0.036 | 3.25 | 0.068 | 0.003 | 0.015 | tr | 0.03 | tr | 0.020 | 0.02 |
| B | 0.042 | 3.27 | 0.072 | 0.004 | 0.003 | 0.020 | 0.02 | 0.012 | 0.025 | 0.02 |
| C | 0.035 | 3.24 | 0.078 | 0.003 | 0.004 | 0.021 | 0.10 | 0.012 | 0.028 | 0.02 |
| D | 0.038 | 3.30 | 0.070 | 0.003 | 0.003 | 0.020 | 0.12 | 0.010 | 0.020 | 0.10 |
| E | 0.035 | 3.26 | 0.065 | 0.004 | 0.017 | tr | 0.09 | 0.005 | tr | 0.02 |
| F | 0.036 | 3.28 | 0.066 | 0.008 | 0.018 | tr | 0.02 | tr | tr | 0.12 |

TABLE 3

| Sample | Decarburization Primary-recrystallization Annealing Method | Marked Oxygen Amount ($g/m^2$) | Surface Oxide Composition Ratio $A_f/A_s$ | Amount of Residual C (%) | Magnetic Flux Density $B_8$(T) | Core Loss $W_{17/50}$ (W/kg) | Coat Bending Adhesion (mmϕ) | Coat Thickness (μm) |
|---|---|---|---|---|---|---|---|---|
| A | 9(a) Conventional Method) | 1.32 | 0.03 | 0.0018 | 1.723 | 1.08 | 60 | 1.25 |
| | 9(f) (Method of the Invention) | 1.35 | 2.38 | 0.0015 | 1.902 | 0.80 | 15 | 0.98 |
| B | 9(a) (Conventional Method) | 1.34 | 0.02 | 0.0016 | 1.694 | 1.14 | 60 | 1.33 |
| | 9(f) (Method of the Invention) | 1.36 | 2.84 | 0.0013 | 1.903 | 0.79 | 15 | 0.95 |
| C | 9(a) (Conventional Method) | 1.30 | 0.01 | 0.0014 | 1.744 | 1.05 | 70 | 1.21 |
| | 9(f) (Method of the Invention) | 1.33 | 3.38 | 0.0011 | 1.901 | 0.81 | 20 | 0.95 |
| D | 9(a) (Conventional Method) | 1.23 | 0.01 | 0.0014 | 1.658 | 1.19 | 60 | 1.03 |
| | 9(f) (Method of the Invention) | 1.26 | 3.01 | 0.0012 | 1.905 | 0.77 | 20 | 0.90 |
| E | 9(a) (Conventional Method) | 1.42 | 0.03 | 0.0013 | 1.773 | 1.08 | 70 | 1.18 |
| | 9(f) (Method of the Invention) | 1.45 | 4.62 | 0.0012 | 1.893 | 0.81 | 15 | 1.05 |
| F | 9(a) (Conventional Method) | 1.40 | 0.02 | 0.0010 | 1.784 | 1.09 | 60 | 1.25 |
| | 9(f) (Method of the Invention) | 1.44 | 4.04 | 0.0010 | 1.895 | 0.83 | 15 | 1.08 |

The steel sheets formed in accordance with the present invention were superior in both the coating and magnetic characteristics as is apparent from Table 3.

EXAMPLE 3

Each of steel ingots having various compositions shown in Table 4 was formed into a hot-rolled sheet having a thickness of 2.2 mm by an ordinary method. This hot-rolled sheet was annealed at 1,000° C. to be made uniform, was acid-cleaned and was thereafter cold-rolled until the thickness was reduced to 1.50 mm. The steel sheet was thereafter subjected to intermediate annealing at 1,100° C. including quenching, cold-rolled until the thickness was reduced to 0.22 mm, and cut into two pieces. These sheets were annealed in accordance with atmosphere pattern (a) (comparative example), and pattern (e) (Example of the present invention) of FIG. 9 to be decarburized and primary-recrystallized. For this annealing, the temperature rising rate was set to 15° C./s (in the range of 400° to 800° C.), the soaking temperature was set to 850° C. and the soaking time was set to 120 seconds. The surface oxide composition control treatment in the case of the pattern (e) was effected at 850° C. for 25 seconds. Table 5 shows values of the marked oxygen amount, the composition ratio $A_f/A_s$ of surface oxides and the amount of residual C of each steel sheet.

An annealing separator containing MgO as a main constituent was applied to each steel sheet, and the steel sheet was finishing-cold-rolled at 1,200° C. for 10 hours.

Table 5 also shows the results of examination of the thickness of the forsterite coat and coating and magnetic characteristics of each product sheet thus obtained.

The steel sheets formed in accordance with the present invention are superior in both coating and magnetic characteristics, as is apparent from Table 5.

TABLE 4

| | Composition (%) | | | | | | | | | | | | | | | |
|---|---|---|---|---|---|---|---|---|---|---|---|---|---|---|---|---|
| Sample | C | Si | Mn | P | Al | S | Se | Mo | Cu | Sb | Ge | Cr | Sn | Bi | B (ppm) | N (ppm) |
| G | 0.079 | 3.28 | 0.075 | 0.004 | 0.024 | 0.004 | 0.021 | tr | 0.01 | 0.025 | tr | 0.01 | 0.02 | tr | 3 | 80 |
| H | 0.070 | 3.31 | 0.074 | 0.003 | 0.025 | 0.005 | 0.020 | tr | 0.02 | 0.026 | tr | 0.01 | 0.02 | tr | 18 | 84 |
| I | 0.068 | 3.24 | 0.080 | 0.004 | 0.021 | 0.003 | 0.018 | tr | 0.02 | tr | tr | 0.01 | 0.01 | 0.008 | 3 | 85 |

TABLE 4-continued

| Sample | Composition (%) | | | | | | | | | | | | | | | |
|---|---|---|---|---|---|---|---|---|---|---|---|---|---|---|---|---|
| | C | Si | Mn | P | Al | S | Se | Mo | Cu | Sb | Ge | Cr | Sn | Bi | B (ppm) | N (ppm) |
| J | 0.065 | 3.28 | 0.072 | 0.005 | 0.019 | 0.004 | 0.021 | tr | 0.07 | tr | tr | 0.01 | 0.12 | tr | 3 | 80 |
| K | 0.073 | 3.30 | 0.077 | 0.018 | 0.020 | 0.002 | tr | tr | 0.01 | tr | tr | 0.01 | 0.02 | tr | 2 | 79 |
| L | 0.077 | 3.24 | 0.069 | 0.003 | 0.025 | 0.003 | 0.020 | 0.010 | 0.02 | 0.030 | tr | 0.01 | 0.02 | tr | 4 | 83 |
| M | 0.070 | 3.27 | 0.073 | 0.004 | 0.027 | 0.004 | 0.022 | tr | 0.03 | 0.024 | 0.010 | 0.01 | 0.02 | tr | 3 | 85 |
| N | 0.069 | 3.31 | 0.068 | 0.005 | 0.024 | 0.004 | 0.019 | 0.010 | 0.15 | 0.020 | tr | 0.01 | 0.02 | tr | 3 | 83 |
| O | 0.073 | 3.25 | 0.075 | 0.003 | 0.022 | 0.016 | tr | tr | 0.07 | tr | tr | 0.01 | 0.12 | tr | 2 | 80 |
| P | 0.075 | 3.32 | 0.077 | 0.005 | 0.027 | 0.004 | 0.020 | tr | 0.08 | tr | tr | 0.08 | 0.02 | tr | 3 | 88 |

TABLE 5

| Sample | Decarburization Primary-recrystallization Annealing Method | Marked Oxygen Amount ($g/m^2$) | Surface Oxide Composition Ratio $A_f/A_s$ | Amount of Residual C (%) | Magnetic Flux Density $B_8$(T) | Core Loss $W_{17/50}$ (W/kg) | Coat Bending Adhesion (mmϕ) | Coat Thickness (μm) |
|---|---|---|---|---|---|---|---|---|
| G | 9(a) (Conventional Method) | 1.03 | 0.01 | 0.0039 | 1.502 | 1.83 | 70 | 0.95 |
| | 9(e) (Method of the Invention) | 1.06 | 2.25 | 0.0015 | 1.932 | 0.84 | 15 | 0.80 |
| H | 9(a) (Conventional Method) | 1.00 | 0.02 | 0.0025 | 1.702 | 1.43 | 60 | 0.97 |
| | 9(e) (Method of the Invention) | 1.05 | 4.03 | 0.0012 | 1.943 | 0.82 | 20 | 0.75 |
| I | 9(a) (Conventional Method) | 1.13 | 0.00 | 0.0028 | 1.869 | 1.16 | 70 | 0.98 |
| | 9(e) (Method of the Invention) | 1.12 | 1.05 | 0.0013 | 1.925 | 0.85 | 20 | 0.82 |
| J | 9(a) (Conventional Method) | 1.05 | 0.01 | 0.0022 | 1.763 | 1.39 | 80 | 0.92 |
| | 9(e) (Method of the Invention) | 1.07 | 1.25 | 0.0010 | 1.927 | 0.83 | 20 | 0.78 |
| K | 9(a) (Conventional Method) | 1.17 | 0.02 | 0.0035 | 1.784 | 1.54 | 50 | 0.98 |
| | 9(e) (Method of the Invention) | 1.19 | 3.04 | 0.0016 | 1.925 | 0.86 | 15 | 0.85 |
| L | 9(a) (Conventional Method) | 0.95 | 0.01 | 0.0038 | 1.803 | 1.35 | 40 | 0.92 |
| | 9(e) (Method of the Invention) | 0.99 | 2.58 | 0.0014 | 1.935 | 0.84 | 15 | 0.72 |
| M | 9(a) (Conventional Method) | 1.03 | 0.03 | 0.0029 | 1.774 | 1.62 | 50 | 0.97 |
| | 9(e) (Method of the Invention) | 1.05 | 3.25 | 0.0012 | 1.930 | 0.85 | 20 | 0.75 |
| N | 9(a) (Conventional Method) | 1.08 | 0.02 | 0.0028 | 1.753 | 1.58 | 60 | 0.83 |
| | 9(e) (Method of the Invention) | 1.10 | 2.89 | 0.0011 | 1.933 | 0.87 | 20 | 0.78 |
| O | 9(a) (Conventional Method) | 1.05 | 0.01 | 0.0033 | 1.794 | 4.38 | 70 | 0.85 |
| | 9(e) (Method of the Invention) | 1.08 | 1.87 | 0.0012 | 1.927 | 0.83 | 20 | 0.79 |
| P | 9(a) (Conventional Method) | 1.12 | 0.02 | 0.0037 | 1.824 | 1.32 | 50 | 0.98 |
| | 9(e) (Method of the Invention) | 1.15 | 2.03 | 0.0016 | 1.928 | 0.85 | 15 | 0.82 |

EXAMPLE 4

The steel ingot B shown in Table 2 was formed into a hot-rolled sheet having a thickness of 2.0 mm by an ordinary method. This hot-rolled sheet was annealed at 1,000° C. to be made uniform, was acid-cleaned and was thereafter cold-rolled until the thickness was reduced to 0.44 mm. The steel sheet was thereafter subjected to intermediate annealing at 950° C., cold-rolled until the thickness was reduced to 0.17 mm, and cut into five pieces. These sheets were annealed under various conditions. For this annealing, the temperature rising rate during the temperature rising period was set to 8° C./s and the soaking temperature was set to 830° C. with respect to each condition. The pattern (a) of FIG. 9 was adopted as an atmosphere pattern of condition (g) for a comparative example. A pattern of condition (h) for an example of the present invention was determined by setting $P(H_2O)/P(H_2)=0.30$ for the first half of the pattern (c) of FIG. 9 and $P(H_2O)/P(H_2)=0.44$ for the second half. Condition (i) for another example of the present invention was the same as condition (h) except that $P(H_2O)/P(H_2)$ during temperature rising was set to 0.45. Condition (j) for still another example of the present invention was determined by using the pattern (d) of FIG. 9 and setting the temperature and the time for retention at this temperature with oxygen potential $P(H_2O)/P(H_2)=0.44$ in the oxidation control step in the second section of this pattern to 890° C. and 25 seconds. Condition (k) for a further example of the present invention was determined by using the pattern (c) of FIG. 9, setting $P(H_2O)/P(H_2)=0.30$ for the first half soaking and $P(H_2O)/P(H_2)=0.44$ for the second half soaking, and increasing the temperature rising rate during temperature rising to 15° C./s.

Table 6 shows the results of examination of the marked oxygen amount and the surface oxide composition ratio $A_f/A_s$, and the amount of residual C of each steel sheet.

An annealing separator containing MgO as a main constituent was applied to each steel sheet, and the steel sheet was treated by finishing cold rolling in $H_2$ at 1,200° C. for 5 hours including secondary recrystallization annealing in $N_2$ at 850° C. for 60 hours. Table 6 also shows the results of examination of the thickness of the forsterite coat and coating and magnetic characteristics of each product sheet thus obtained.

Thus, according to the present invention, an oriented silicon steel sheet having improved magnetic and coating characteristics can be obtained even if the thickness of the product is reduced.

TABLE 6

| Decarburization Primary-recrystallization Annealing Condition | Marked Oxygen Amount ($g/m^2$) | Surface Oxide Composition Ratio $A_r/A_s$ | Amount of Residual C (%) | Magnetic Flux Density $B_8$(T) | Core Loss $W_{17/50}$ (W/kg) | Coat Bending Adhesion (mmϕ) | Coat Thickness (μm) | Note |
|---|---|---|---|---|---|---|---|---|
| (g) | 1.33 | 0.03 | 0.0015 | 1.658 | 1.17 | 60 | 1.33 | Comparative Example |
| (h) | 1.39 | 2.54 | 0.0013 | 1.905 | 0.80 | 20 | 0.97 | Example of the Invention |
| (i) | 1.42 | 1.53 | 0.0015 | 1.908 | 0.79 | 15 | 0.99 | Example of the Invention |
| (j) | 1.38 | 3.05 | 0.0015 | 1.905 | 0.79 | 15 | 0.98 | Example of the Invention |
| (k) | 1.48 | 2.30 | 0.0012 | 1.903 | 0.80 | 15 | 2 | Example of the invention |

What is claimed is:

1. A thin grain oriented decarburized silicon steel sheet having improved magnetic and coating characteristics and having at its steel sheet surface an undissolved subscale comprising a fayalite-silica composition having an infrared reflection absorbance ratio $A_f/A_s$ in the range of about 0.5–5.5 at the surface of said subscale and having a marked oxygen amount of about 0.4–1.6 $g/m^2$.

2. The thin grain oriented decarburized silicon steel sheet defined in claim 1, having a final thickness of about 0.28 mm or less.

* * * * *